US010823038B2

(12) United States Patent
Mueller et al.

(10) Patent No.: US 10,823,038 B2
(45) Date of Patent: Nov. 3, 2020

(54) VEHICLE COMPONENT

(71) Applicant: Dr. Ing. h.c. F. Porsche Aktiengesellschaft, Stuttgart (DE)

(72) Inventors: Moritz-Alexander Mueller, Bad Zwischenahn (DE); Stephan Schoell, Stuttgart (DE); Thomas Weiss, Tamm (DE)

(73) Assignee: Dr. Ing. h.c.F. Porsche Aktiengesellschaft (DE)

( * ) Notice: Subject to any disclaimer, the term of this patent is extended or adjusted under 35 U.S.C. 154(b) by 322 days.

(21) Appl. No.: 15/813,329

(22) Filed: Nov. 15, 2017

(65) Prior Publication Data

US 2018/0149071 A1 May 31, 2018

(30) Foreign Application Priority Data

Nov. 30, 2016 (DE) ..... 10 2016 123 114

(51) Int. Cl.
*F01N 13/18* (2010.01)
*F01N 13/08* (2010.01)

(52) U.S. Cl.
CPC ..... *F01N 13/1811* (2013.01); *F01N 13/08* (2013.01); *F01N 13/082* (2013.01); *F01N 13/1838* (2013.01)

(58) Field of Classification Search
CPC .... F01N 13/1811; F01N 13/08; F01N 13/082; F01N 13/1838
USPC ..... 181/228
See application file for complete search history.

(56) References Cited

U.S. PATENT DOCUMENTS 7,032,702 B2 * 4/2006 Rinklin ..... B60K 13/04 180/309
8,312,961 B2 * 11/2012 Won ..... F01N 13/20 180/309
8,443,933 B2 * 5/2013 Pfeffer ..... F01N 13/08 181/227
8,875,836 B2 * 11/2014 Park ..... F01N 13/082 181/227
2002/0053483 A1 * 5/2002 Ebinger ..... F01N 13/082 181/227

(Continued)

FOREIGN PATENT DOCUMENTS

DE 10258250 A1 7/2004
DE 102013214612 A1 1/2015

(Continued)

OTHER PUBLICATIONS

German Search Report dated Dec. 15, 2017.

*Primary Examiner* — Forrest M Phillips
(74) *Attorney, Agent, or Firm* — Gerald E. Hespos; Michael J. Porco; Matthew T. Hespos

(57) ABSTRACT

A vehicle component (100) having an exhaust-gas tailpipe device (1) for an exhaust-gas system of a motor vehicle includes at least one exhaust-gas tailpipe (2) and an exhaust-gas tailpipe trim (3) that, in a crash situation, can be pushed at least in sections onto the exhaust-gas tailpipe (2). The exhaust-gas tailpipe device (1) has at least one shield element (4) that is designed for noise optimization and that is fastened in front of the exhaust-gas tailpipe trim (3) by means of at least one predetermined breaking device (5). Thus, in the crash situation, the shield element (4) can be pushed at least in sections onto the exhaust-gas tailpipe (2).

13 Claims, 4 Drawing Sheets

(56) References Cited

U.S. PATENT DOCUMENTS

| | | | | |
|---|---|---|---|---|
| 2004/0163874 | A1* | 8/2004 | Rinklin | B60K 13/04 180/309 |
| 2013/0240289 | A1* | 9/2013 | Schmitt | F01N 13/082 181/228 |
| 2015/0337713 | A1* | 11/2015 | Callahan | F01N 13/08 181/228 |

FOREIGN PATENT DOCUMENTS

| | | | | |
|---|---|---|---|---|
| DE | 102013021691 | A1 | 6/2015 | |
| EP | 1925791 | A1 | 5/2008 | |
| EP | 2031204 | A2 | 3/2009 | |
| JP | 06117243 | A * | 4/1994 | F01N 13/1816 |
| KR | 100877857 | B1 | 1/2009 | |
| KR | 200459849 | Y1 | 4/2012 | |

* cited by examiner

VEHICLE COMPONENT

CROSS REFERENCE TO RELATED APPLICATION

This application claims priority under 35 USC 119 to German Patent Appl. No. 10 2016 123 114.2 filed on Nov. 30, 2016, the entire disclosure of which is incorporated herein by reference.

BACKGROUND

Field of the Invention

The invention relates to a vehicle component having at least one exhaust-gas tailpipe device for an exhaust-gas system of a motor vehicle, having at least one exhaust-gas tailpipe and at least one exhaust-gas tailpipe trim. In a crash situation, the exhaust-gas tailpipe trim can be pushed at least in sections onto the exhaust-gas tailpipe.

Description of the Related Art

The tailpipe of an exhaust-gas system commonly is equipped with a trim. The trim often is arranged on the vehicle in a protruding manner to permit a reliable discharge of the exhaust gases and to influence the overall visual appearance.

As a result of the protrusion, an impact against the trim can lead to considerable and normally very expensive damage to the entire exhaust-gas system. In the prior art, it is therefore known for the trim to be fastened to the tailpipe in such a manner that it can be pushed onto the tailpipe.

Furthermore, the noise characteristic is a particularly important feature of high-grade exhaust-gas systems. However, measures for noise optimization must not block the pushing of the trim onto the tailpipe, such as is required in the crash situation.

It is therefore the object of the invention to provide a noise-optimized exhaust-gas tailpipe device that exhibits particularly expedient crash behavior.

SUMMARY

The vehicle component according to the invention comprises at least one exhaust-gas tailpipe device for an exhaust-gas system of a motor vehicle. The exhaust-gas tailpipe device comprises at least one exhaust-gas tailpipe and at least one exhaust-gas tailpipe trim. In a crash situation, the exhaust-gas tailpipe trim can be pushed at least in sections onto the exhaust-gas tailpipe. The exhaust-gas tailpipe device comprises at least one shield element that is designed for noise optimization. The shield element is fastened in front of the exhaust-gas tailpipe trim by at least one predetermined breaking device. The breaking device is suitable and designed for realizing a situation in which, in the crash situation, the shield element can be pushed at least in sections onto the exhaust-gas tailpipe.

A shield element designed for noise optimization may be fastened in front of the exhaust-gas tailpipe trim by at least one predetermined breaking device. Thus, noises and/or sound can be reduced considerably, and/or a particular tone of the exhaust-gas system can be generated by the shield element arranged in front of the exhaust-gas tailpipe trim. Reliable strengthening of the crash behavior of the shield element is achieved due to the fastening by the predetermined breaking device.

Both the shield element and the exhaust-gas tailpipe trim of the vehicle component may be pushed onto the exhaust-gas tailpipe. Thus, a noise-optimized exhaust-gas system is provided that reliably counteracts the transmission of a shock to the rest of the exhaust-gas system even in the event of a crash acting on the exhaust-gas tailpipe trim.

The shield element may be arranged upstream of the exhaust-gas tailpipe trim in the operational flow direction of the exhaust gases. The flow direction of the exhaust gases runs from the internal combustion engine in the direction of an outlet opening of the exhaust-gas system.

The shield element may be fastened to the exhaust-gas tailpipe. The predetermined breaking device may be assigned to the connection between shield element and exhaust-gas tailpipe. It is thus possible for the shield element to be separated from the exhaust-gas tailpipe in the crash situation. The shield element may be fastened indirectly or directly to the exhaust-gas tailpipe.

The shield element may be fastened to the exhaust-gas tailpipe by at least one holding element. The predetermined breaking device may be suitable and designed for splitting the holding element into at least two component parts in the crash situation. This permits a durable fastening of the shield element and permits a reliable detachment. It is possible for the holding element to be connected at least partially to the exhaust-gas tailpipe trim.

The predetermined breaking device may be suitable and designed for splitting the holding element into at least one part that remains on the exhaust-gas tailpipe, and at least one part that remains on the shield element in the crash situation. The holding element may be welded, and/or fastened in some other suitable way, by one component part to the shield element. The holding element may be welded, and/or fastened in some other suitable way, by means of the other component part to the exhaust-gas tailpipe. This permits quick and uncomplicated installation of the shield element and ensures a stable connection without rattling noises.

The component parts may be connected to one another by a multiplicity of connecting bridges in the operational state or before the crash situation. The connecting bridges may be suitable and designed for shearing in the crash situation. The component parts also may be connected to one another by only one or two connecting bridges. Such connecting bridges offer a reliable connection of the component parts.

The connecting bridges may extend transverse to the exhaust-gas tailpipe. In particular, the connecting bridges may extend transverse to a longitudinal direction of the exhaust-gas tailpipe. The connecting bridges also may extend radially with respect to the exhaust-gas tailpipe. It is also possible for the connecting bridges to extend tangentially with respect to the exhaust-gas tailpipe. The individual connecting bridges may extend in the same way or in different ways with respect to the exhaust-gas tailpipe. For example, some connecting bridges may be arranged radially, and other connecting bridges may be arranged tangentially. Connecting bridges designed in this way offer a durable fastening, and shear in a particularly reliable manner in the crash situation.

At least one of the two component parts may surround the exhaust-gas tailpipe in a ring-like manner. In particular, the exhaust-gas tailpipe may be surrounded by that component part that is fastened to the exhaust gas tailpipe and/or that remains fastened to said exhaust-gas tailpipe after shearing.

At least one of the two component parts may be designed in a ring-like manner and/or may be provided by at least one ring-shaped body. In this way, the component part can be fastened in a particularly closely abutting manner to a tubular exhaust-gas tailpipe. In particular, a gap and/or a spacing between exhaust-gas tailpipe trim and exhaust-gas tailpipe can be closed by one of the two component parts.

One component part may be surrounded in a ring-like manner by the other component part. The ring-like design may be of circular or oval or curved or polygonal design. In particular, the inner side of the component part that is directed toward the other component part may be of ring-like design. In particular, each of the two component parts may provide a ring-like structure, and those structures may be connected to one another by the connecting bridges and in particular by radial connecting bridges.

Two exhaust gas tailpipes may be coupled to form a dual tailpipe. It is also possible for three or more exhaust-gas tailpipes to be coupled to form one common tailpipe. Each exhaust-gas tailpipe may have at least one component part fastened thereto. In particular, each of the two tailpipes may be surrounded in a ring-like manner by a component part. In particular, said component parts then may be surrounded by another, common component part that is fastened to the shield element. For example, two inner ring-shaped component parts may be provided and may be surrounded by a common outer ring-like component part. However, the component parts may be surrounded by a different component part in each case.

The holding element may be provided by at least one unitary holding plate. The component parts of a holding plate of this type may be connected by shearable plate webs. Such a design is inexpensive to produce and ensures a permanent fastening and reliable shearing in the crash situation.

The holding plate may comprise a multiplicity of recesses. In particular, the plate webs may be surrounded by recesses. In particular, recesses are arranged between the two component parts. The holding plate may be provided by the two component parts that are separated by recess and connected by means of the plate webs. In particular, the recesses may be formed into the holding plate in such a way that the component parts are connected to one another only by means of the plate webs.

In the crash situation, the exhaust-gas tailpipe trim may press against the shield element, and/or against the component part remaining on the shield element and, in so doing, pushes the shield element over the exhaust-gas tailpipe. The cross section of the component part fastened to the shield element may be adapted to the cross section of the exhaust-gas tailpipe trim. In this way, the exhaust-gas tailpipe trim impacts against the component part on the shield element in a targeted manner in the crash situation. In particular, the diameter of a ring-like component part is coordinated with the diameter of a tubular exhaust-gas tailpipe trim.

The exhaust gas tailpipe trim may be tubular at least in sections. In particular, the exhaust-gas tailpipe trim comprises at least one front and at least one rear tube opening. The rear tube opening may be directed toward the outlet end of the exhaust-gas system. The front tube opening may be averted from the outlet opening.

The shield element may have a protrusion in relation to a front tube opening of the exhaust-gas tailpipe trim. The protrusion may be more than 5 mm and preferably more than 10 mm and particularly preferably 15 mm or more. A protrusion of 20 mm or 30 mm or even 80 mm or more is also possible. A protrusion of 15 mm particularly preferably is provided. A deviation of one millimeter or even several millimeters may be provided.

The shield element may be arranged with a spacing of less than 50 mm and in particular of less than 25 mm, and particularly preferably with a spacing of between 10 mm and 20 mm, to a front tube opening. For example, the shield element is arranged with a spacing of 15 mm to a front tube opening of the exhaust-gas tailpipe trim.

The protrusion and/or the spacing may also be configured in relation to the diameter of the tailpipe. For example, the spacing and/or the protrusion may correspond to one half or else one third or quarter or eighth or even tenth of the tailpipe diameter.

By means of such a spacing and a corresponding protrusion, it is possible to achieve particularly expedient sound reflection by means of the shield element. Particularly good sound reflection is obtained by as small a spacing as possible.

The front tube opening of the exhaust-gas tailpipe trim may be larger than a rear tube opening. In particular, a funnel-shaped design of the exhaust-gas tailpipe trim may be provided. In this way, the sound distribution can be influenced in a particularly effective manner by means of the exhaust-gas tailpipe trim, such that correspondingly expedient sound reflection is achieved by means of the shield element.

The exhaust-gas tailpipe trim may surround the exhaust-gas tailpipe in a manner so that a flow connection is provided between the front tube opening and the rear tube opening. In particular, a spacing may be provided between the exhaust-gas tailpipe and the tube openings of the exhaust-gas tailpipe trim. In particular, the inner diameter of the front tube opening and/or of the rear tube opening may have an oversize in relation to the outer diameter of the exhaust-gas tailpipe. In the case of an exhaust-gas tailpipe trim designed in this way, sound waves are reflected by the shield element in a particularly effective manner.

The shield element may be formed as a shield plate. The shield element may be of panel-like and/or disk-like form. In particular, the shield element may surround the exhaust-gas tailpipe with a closed circumference. For example, the shield element has at least one passage opening for the exhaust-gas tailpipe. Such a shield plate can be produced particularly inexpensively, and is uncomplicated to install. Furthermore, a shield plate of this type offers shielding an effective reflection of the occurring sound.

The exhaust-gas tailpipe trim protrudes beyond the rear end of the exhaust-gas tailpipe. It is possible for the exhaust-gas tailpipe trim to be fastened to the exhaust-gas tailpipe and/or some other vehicle part structure. The exhaust-gas tailpipe trim also may be fastened by at least one predetermined breaking device.

The applicant reserves the right to claim a vehicle component that comprises at least one exhaust-gas tailpipe device for an exhaust-gas system of a motor vehicle. The exhaust-gas tailpipe device comprises at least one exhaust-gas tailpipe and at least one exhaust-gas tailpipe trim that can be pushed at least in sections onto the exhaust-gas tailpipe in a crash situation. The exhaust-gas tailpipe device is characterized in that the exhaust-gas tailpipe device comprises at least one shield element designed for noise optimization, which shield element is fastened in front of the exhaust-gas tailpipe trim.

Further advantages and features of the present invention will emerge from the exemplary embodiments, which will be discussed below with reference to the appended figures.

DETAILED DESCRIPTION

Figure 1:
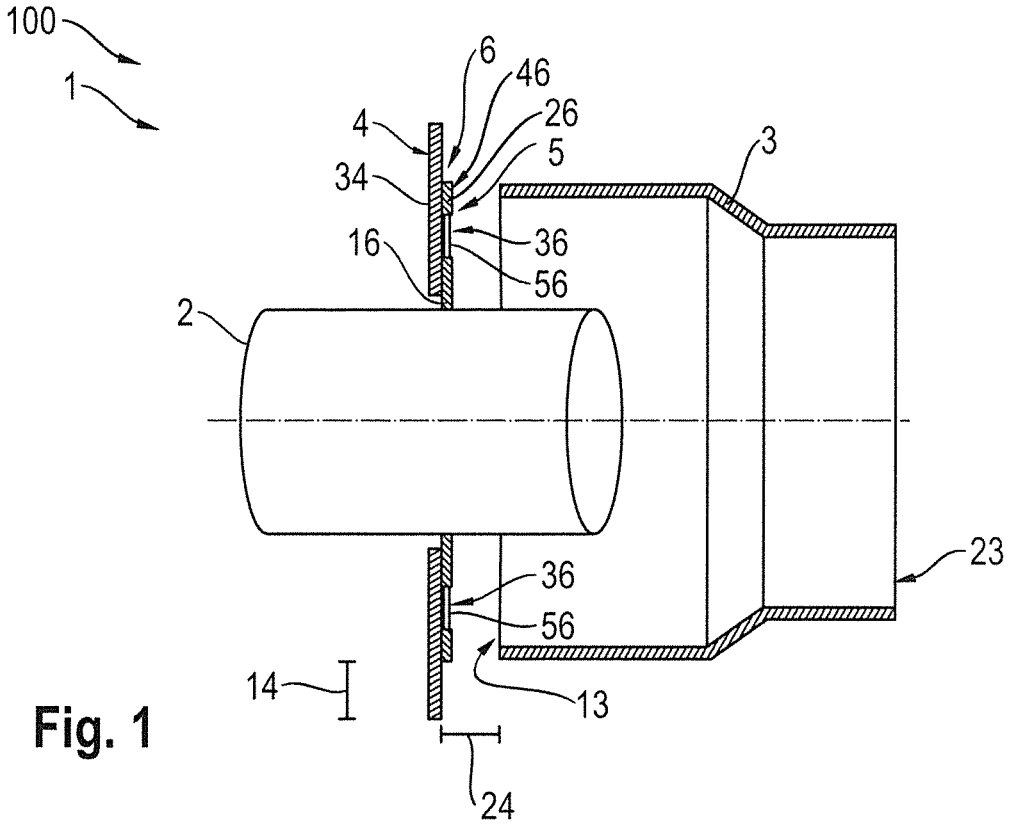
FIG. 1 is a highly schematic illustration of an exhaust-gas tailpipe device of a vehicle component according to the invention in the operational state.

FIG. 1 shows a vehicle component 100 according to the invention having at least one exhaust-gas tailpipe device for an exhaust-gas system of a motor vehicle. The vehicle component 100 may also comprise further components or parts not illustrated here. For example, the vehicle component 100 may also comprise a silencer device for the exhaust-gas system of the motor vehicle.

The exhaust-gas tailpipe device 1 comprises an exhaust-gas tailpipe 2 and an exhaust-gas tailpipe trim 3. The exhaust-gas tailpipe trim 3 is part of the rear paneling or is fastened to the rear paneling and, in this case, is arranged in the region of a rear opening of the exhaust-gas tailpipe 2, through which the exhaust gases are discharged from the exhaust-gas system. The exhaust-gas tailpipe trim 3 is in this case of tubular form. For the discharge of the exhaust gases, the exhaust-gas tailpipe trim 3 has a rear tube opening 23.

Furthermore, the exhaust-gas tailpipe trim 3 has, in this case, a front tube opening 13. The front tube opening 13 is in this case formed with a larger diameter than the rear tube opening 23. This yields a funnel-shaped design of the exhaust-gas tailpipe trim 3. Here, the section with the larger cross section or diameter has been partially pushed onto the exhaust-gas tailpipe 2.

Here, a shield element 4 is arranged upstream of the exhaust-gas tailpipe trim 3 in the flow direction of the exhaust gases. The shield element 4 serves in this case in particular for reflecting emerging sound waves, such that a noise optimization of the exhaust-gas system is realized by means of the shield element.

The shield element 4 is a shield plate 34. To realize advantageous noise optimization, the shield element 4 is arranged with as small as possible a spacing 24 to the front tube opening 13 of the exhaust-gas tailpipe trim 3. For example, the spacing 24 amounts to 15 mm. Smaller or larger spacings 24 are also possible.

To realize particularly effective reflection of the sound waves, the shield element 4 is in this case arranged with a protrusion 14 with respect to the front tube opening 13 of the exhaust-gas tailpipe trim 3. The protrusion 14 preferably extends in encircling fashion around the entire front tube opening 13.

In the example shown here, the protrusion 14 amounts to 15 mm. It is also possible for larger or smaller protrusions 14 to be provided. It is also possible for regions with relatively large or relatively small protrusions 14 to be provided, depending on the contour of the shield element 4 and/or of the exhaust-gas tailpipe trim 3.

Such an arrangement of the shield element 4 in front of the front tube opening 13 yields a type of labyrinth seal that permits effective noise reduction. For example, it was possible to reduce the critical interior compartment noise level by up to 4 dB. The arrangement of the shield element 4 in front of the exhaust-gas tailpipe trim 3, as proposed here, thus offers a considerable reduction of undesired noises or sound.

The exhaust-gas tailpipe trim 3 protrudes beyond the exhaust-gas tailpipe 2. The exhaust-gas tailpipe trim 3 is designed to be pushed onto the exhaust-gas tailpipe 2. In this way, if a force acts on the exhaust-gas tailpipe trim 3, for example in the event of a minor rear-end collision or if an obstruction is driven into, expensive damage to the exhaust-gas tailpipe 2 and/or to the exhaust-gas system connected thereto is prevented.

For this purpose, the exhaust-gas tailpipe trim 3 may be fastened to the exhaust-gas tailpipe and/or to some other vehicle part structure for example by means of a predetermined breaking device, in a manner not shown here. The predetermined breaking point may be designed so that the action of force causes a breakage and/or a deformation, resulting in a displacement of the exhaust-gas tailpipe trim 3 relative to the exhaust-gas tailpipe 2.

The shield element 4 is fastened in front of the exhaust-gas tailpipe trim 3 by a breaking device 5 so that the pushing of the exhaust-gas tailpipe trim 3 onto the exhaust-gas tailpipe 2 is not impeded in the crash situation. The breaking device 5 is assigned to the connection between the shield element 4 and exhaust-gas tailpipe 2. For this purpose, the shield element 4 is fastened (preferably welded) to the exhaust-gas tailpipe 2 via a holding element 6. The shield element 4 also is fastened, and preferably welded, to the holding element 6. Other suitable fastening means may be provided.

The holding element 6 comprises in this case a multiplicity of connecting bridges 36 which extend between two component parts 16, 26. Here, one component part 16 is fastened, and for example welded, to the exhaust-gas tailpipe. The other component part 26 is connected, and for example welded, to the shield element 4.

The connecting bridges 36 provide the defined weak points of the breaking device 5. In a crash situation, the connecting bridges 36 break, so that the holding element 6 splits into the two component parts 16, 26. In the event of a breakage of the connecting bridges 36, one component part 16 remains on the exhaust-gas tailpipe 2, and the other component part 26 remains on the shield element 4.

The shield element 4 is a unitary holding plate 46. The connecting bridges 36 are in this case formed as plate webs 56. Such plate webs 56 can be formed with little outlay into a shield element 4 formed as a holding plate 46, and offer reliable predetermined breaking points.

In particular, the shield element 4 surrounds the exhaust-gas tailpipe 2 over a full circumference. To ensure that the shield element 4 is pushed onto the exhaust-gas tailpipe 2 in an effective manner in the crash situation, a targeted spacing is provided between the exhaust-gas tailpipe 2 and shield element 4. To prevent the passage of sound in the region of said spacing, the holding element 6, or the component part 16 of the holding element 6, extends across said spacing. For example, the component part 16 surrounds the exhaust-gas tailpipe 2 in a ring-like manner, and is in particular fastened, and for example welded, to said exhaust-gas tailpipe in a gapless manner.

Figure 2:
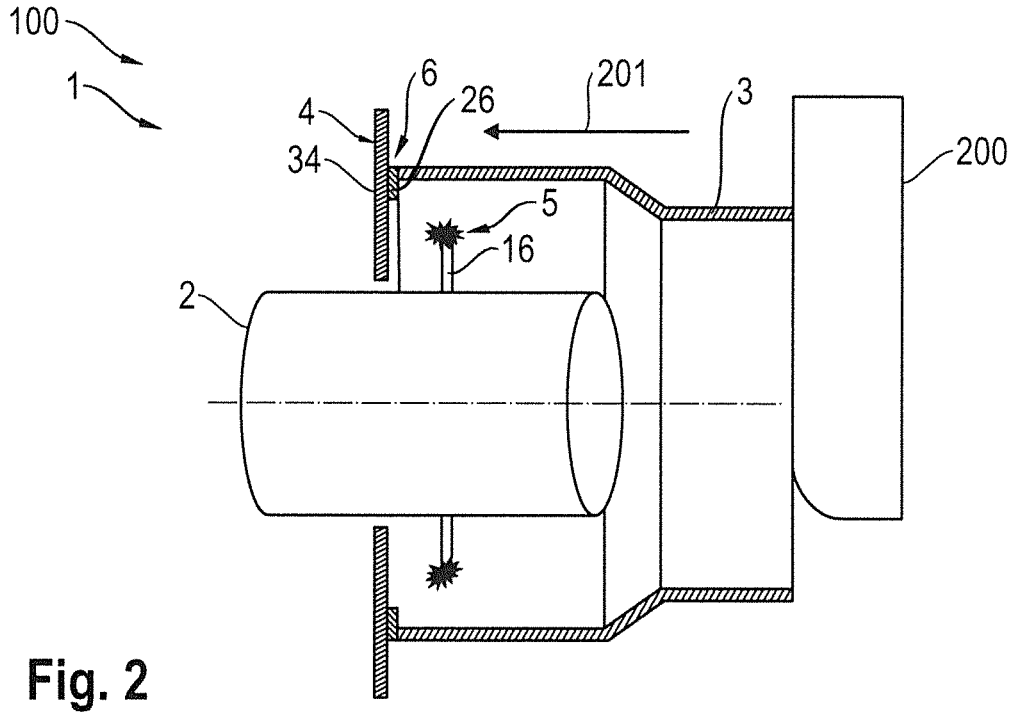
FIG. 2 shows the exhaust-gas tailpipe device from FIG. 1 in a crash situation.

FIG. 2 shows the vehicle component 1 from FIG. 1 after a detachment of the breaking device 5. This may occur for example in a crash situation or as a result of a crash test. Such a test may for example be a pendulum crash test and/or an RCAR structural test. The detachment of the breaking device 5 is caused by a body 200 that acts on the exhaust-gas tailpipe trim 3 in the impacted direction 201 indicated in this case by an arrow. It is possible that, in the crash situation, plastic deformation can occur despite detachment of the breaking point 5 and pushing of the exhaust-gas tailpipe trim and/or of the shield element onto the exhaust-gas tailpipe 2.

As a result of the action of the impact, the front tube opening 13 of the exhaust-gas tailpipe trim 3 presses against the component part 26 fastened to the shield element 4. As a result, the connecting bridges 36 are broken, and the shield element 4 is pushed onto the exhaust-gas tailpipe 2 by the exhaust-gas tailpipe trim 3. One component part 16 has remained on the exhaust-gas tailpipe 2. Thus, expensive damage to the exhaust-gas tailpipe 2, or to other parts of the exhaust-gas system is prevented.

The component part 26 fastened to the shield element 4 is in this case adapted to the cross section or the contour of the exhaust-gas tailpipe trim 3 in the region of the front tube opening 13. Such a test may for example be a pendulum crash test and/or an RCAR structural test.

Furthermore, the component part 16 that remains on the exhaust-gas tailpipe 2 in the crash situation is designed with a smaller cross section than the front tube opening 13. In this way, the exhaust-gas tailpipe trim 3 can be pushed over the component part 16 that remains on the exhaust-gas tailpipe 2.

Figure 3:
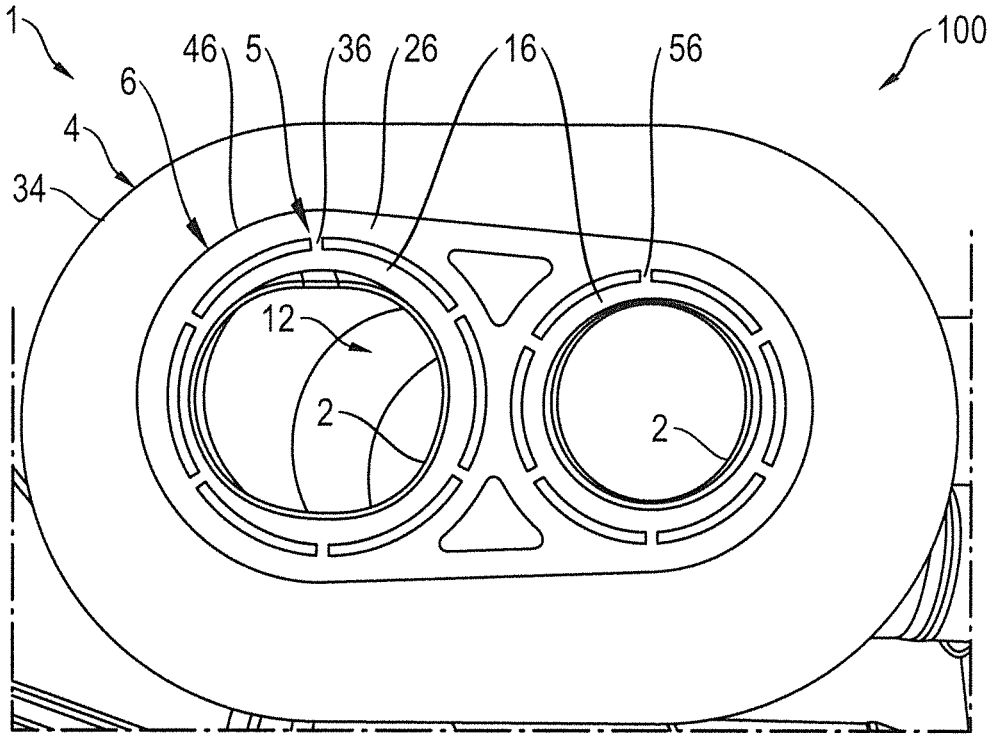
FIG. 3 is a schematic illustration of an exhaust-gas tailpipe device in a view from the rear.

FIG. 3 shows a vehicle component 100 having an exhaust-gas tailpipe device 1 in a rear view. The exhaust-gas tailpipe device 1 comprises in this case two exhaust-gas tailpipes 2 that are arranged to form a dual tailpipe 12. For sound reflection, use is made of a shield element 4 that is formed as a shield plate 34 and surrounds both tailpipes 2. For a better overview, the exhaust-gas tailpipe trim 3 has not been shown here.

The design of the holding element 4 with the component parts 16, 26 can be seen clearly here. To each exhaust-gas tailpipe 2 there is fastened in each case one component part 16 that remains thereon in the crash situation. Both component parts 16 are connected by radial connecting bridges 36 to a common component part 26 that is fastened to the shield element 4. The component parts 16, 26 are ring-like and surround the respective exhaust-gas tailpipes 2.

The holding element 6 is a holding plate 46 that provides the connecting bridges 36 by plate webs 56. Recesses are formed in the holding plate 46 between the plate webs 56. The shield element 4 is positioned behind the recesses in the holding element 6. Thus, reliable sound reflection is realized even in the regions of the recesses.

Figure 4:
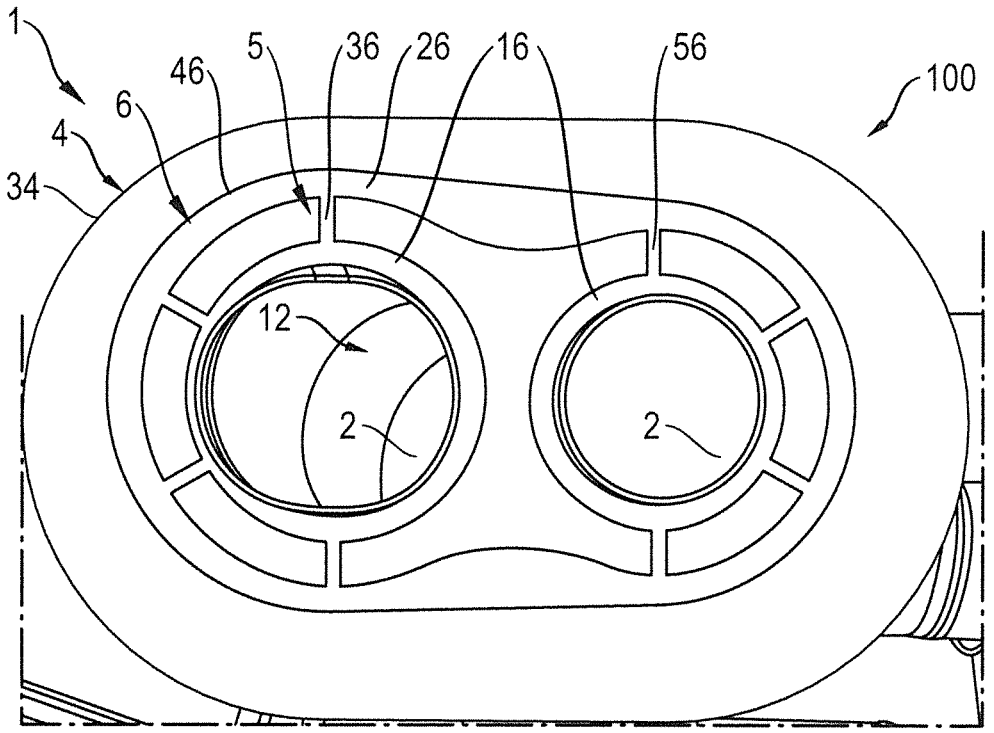
FIG. 4 is a highly schematic illustration of a further exhaust-gas tailpipe device in a rear view.

FIG. 4 shows a refinement of the vehicle component described above. The holding element 6 is in this case formed with connecting bridges 36 of alternative design.

The design of the holding element 6 and the number of connecting bridges 36 and/or the shaping of the component parts 16, 26 are adapted to the holding forces required during operation. In particular, the holding element 6 is designed so that adequate component strength and/or component stiffness during driving operation can be ensured. At the same time, the holding device 6 is designed so that a reliable detachment of the predetermined breaking device 5 in the crash situation can be ensured.

Figure 5:
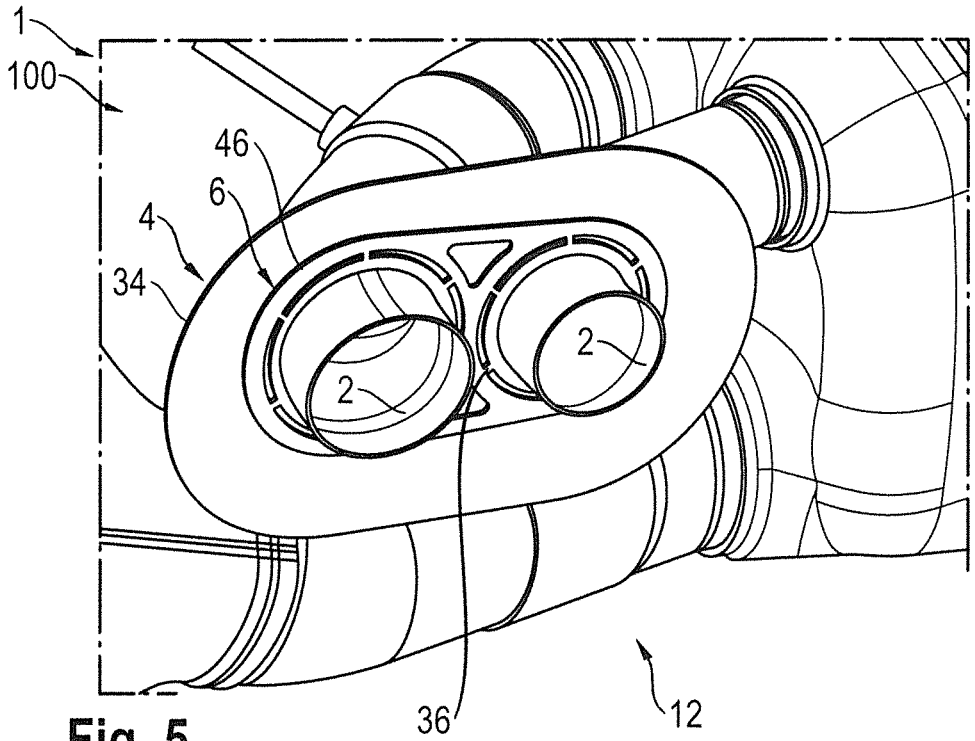
FIG. 5 shows the exhaust-gas tailpipe device of FIG. 3 in a perspective view.

FIG. 5 shows the vehicle component 100 from FIG. 3 in a perspective illustration obliquely from above. The profile of the exhaust-gas tailpipes 2, and the shield element 4 arranged thereon and the holding element 6, can be seen particularly clearly.

Figure 6:
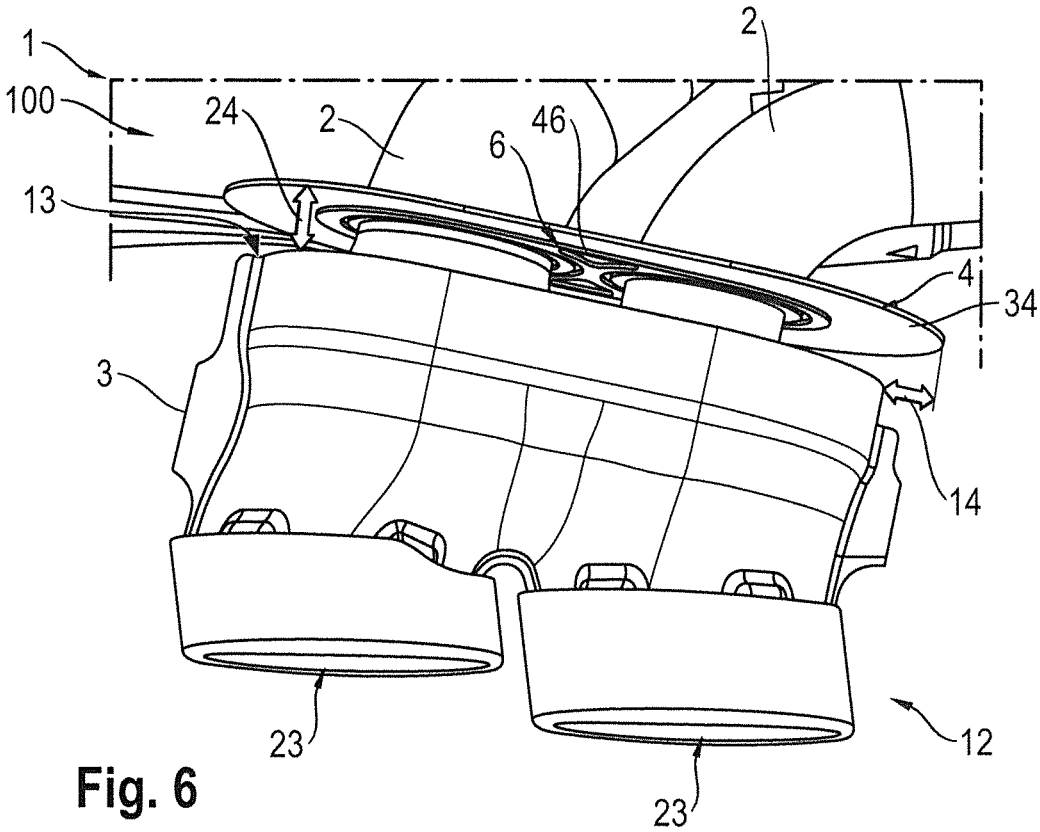
FIG. 6 shows the exhaust-gas tailpipe device of FIG. 5 from a different perspective and with an exhaust-gas tailpipe trim.

FIG. 6 shows the vehicle component 100 from FIG. 3, with an exhaust-gas tailpipe trim 3 arranged in the intended manner, in a view from above. The protrusion 14 of the shield element 4 with respect to the front tube opening 13 of the exhaust-gas tailpipe trim 3 can be clearly seen here. The spacing 24 provided between shield element 4 and front tube opening 13 can likewise be clearly seen.

Figure 7:
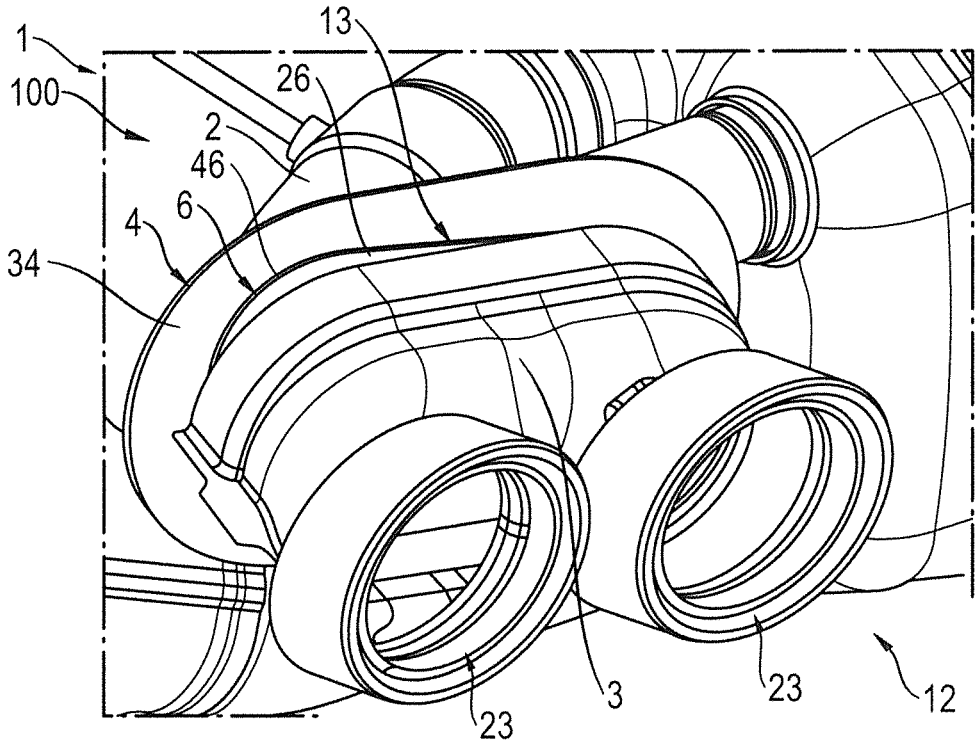
FIG. 7 shows the exhaust-gas tailpipe device of FIG. 6 from a perspective obliquely from the rear.
Figure 8:
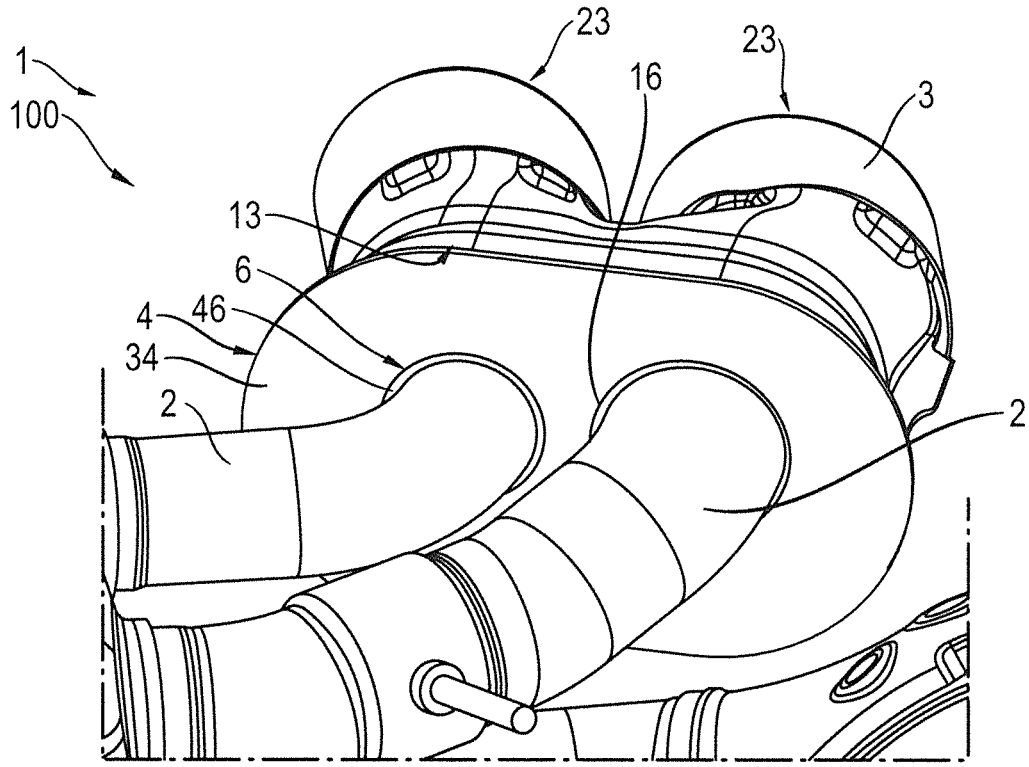
FIG. 8 shows the exhaust-gas tailpipe device of FIG. 6 in a perspective obliquely from the front.

FIGS. 7 and 8 show the vehicle component 100 illustrated in FIG. 6 in a perspective view obliquely from the rear and in a perspective view obliquely from the front. Here, in FIG. 8, it can be seen particularly clearly that the spacing of the shield element 4 with respect to the exhaust-gas tailpipe 2 is closed by the component part 16 fastened to the respective exhaust-gas tailpipe 2. Thus, reliable sound reflection can be ensured during driving operation. After the breakaway of the connecting bridges 36 in the crash situation, the shield element 4 is then pushed onto the respective exhaust-gas tailpipe 2 in a freely moving manner owing to the spacing.

LIST OF REFERENCE DESIGNATIONS

1 Exhaust-gas tailpipe device
2 Exhaust-gas tailpipe
3 Exhaust-gas tailpipe trim
4 Shield element
5 Predetermined breaking device
6 Holding element
12 Dual tailpipe
13 Tube opening
14 Protrusion
16 Component part
23 Tube opening
24 Spacing
26 Component part
34 Shield plate
36 Connecting bridge
46 Holding plate
56 Plate web
100 Vehicle component
200 Body
201 Impact direction

What is claimed is:

1. A vehicle component for an exhaust-gas system of a motor vehicle, comprising:

at least one exhaust-gas tailpipe having a rear end;

a shield element having an inner periphery that is fastened to the at least one exhaust-gas tailpipe in front of the rear end of the exhaust-gas tailpipe, an outer periphery and at least one breaking device inward from the outer periphery and defining at least one area of the shield element that is weaker than all other areas of the shield element; and at least one exhaust-gas tailpipe trim having a rear end rearward of the rear end of the at least one exhaust-gas tailpipe, a front end forward of the rear end of the at least one exhaust-gas tail pipe, areas of the at least one exhaust-gas tailpipe trim adjacent the front end of the at least one exhaust-gas tailpipe trim surrounding areas of the at least one exhaust-gas tailpipe forward of the rear end of at least one exhaust-gas tailpipe, the front end of the at least one exhaust-gas tailpipe trim being spaced rearward of the shield element and being outward of the at least one breaking device so that, in a crash situation, areas of the shield element outward of the breaking device can be pushed at least in sections onto the exhaust-gas tailpipe.

2. The vehicle component of claim 1, wherein the shield element is fastened to the exhaust-gas tailpipe by at least one holding element, and wherein the breaking device is suitable and designed for splitting the holding element into at least two component parts in the crash situation.

3. The vehicle component of claim 2, wherein the breaking device is suitable and designed for splitting the holding element into at least one of the component parts that remains on the exhaust-gas tailpipe, and at least one of the component parts that remains on the shield element in the crash situation.

4. The vehicle component of claim 2, wherein the component parts are, in an operational state, connected to one another by connecting bridges that shear in the crash situation.

5. The vehicle component of claim 4, wherein the connecting bridges extend transversely, radially or tangentially with respect to the exhaust-gas tailpipe.

6. The vehicle component of claim 2, wherein at least one of the two component parts surrounds the exhaust-gas tailpipe in a ring-like manner.

7. The vehicle component of claim 2, wherein one component part is surrounded in a ring-like manner by the other component part.

8. The vehicle component of claim 2, wherein two exhaust-gas tailpipes are coupled to form a dual tailpipe, and wherein, for each exhaust-gas tailpipe, there is provided in each case one component part fastened thereto.

9. The vehicle component of claim 2, wherein the holding element is provided by at least one unitary holding plate, and wherein the two component parts are connected by plate webs that can shear in the crash situation.

10. The vehicle component of claim 2, wherein, in the crash situation, the exhaust-gas tailpipe trim presses against the shield element, and/or against the component part remaining on the shield element, and pushes the shield element over the exhaust-gas tailpipe.

11. The vehicle component of claim 2, wherein the exhaust-gas tailpipe trim is tubular at least in sections, and wherein the shield element is arranged with a protrusion in relation to a front tube opening, and/or wherein the shield element is arranged with a spacing of less than 50 mm to a front tube opening.

12. The vehicle component of claim 11, wherein the front tube opening is larger than a rear tube opening to define a funnel-shape for the exhaust-gas tailpipe trim.

13. The vehicle component of claim 11, wherein the shield element is a shield plate.

* * * * *